US008963716B2

(12) United States Patent
Zhu et al.

(10) Patent No.: US 8,963,716 B2
(45) Date of Patent: Feb. 24, 2015

(54) STORAGE CONTAINER FOR ELECTRONICALLY ADDRESSABLE FILE FOLDERS AND DOCUMENTS

(71) Applicants: Shengbo Zhu, San Jose, CA (US); Su Shiong Huang, Bellevue, WA (US)

(72) Inventors: Shengbo Zhu, San Jose, CA (US); Su Shiong Huang, Bellevue, WA (US)

(73) Assignee: iMicrodata Corporation, San Jose, CA (US)

( * ) Notice: Subject to any disclaimer, the term of this patent is extended or adjusted under 35 U.S.C. 154(b) by 63 days.

(21) Appl. No.: 13/694,829

(22) Filed: Jan. 8, 2013

(65) Prior Publication Data

US 2014/0191633 A1 Jul. 10, 2014

(51) Int. Cl.

| | |
|---|---|
| ***G08B 13/14*** | (2006.01) |
| ***B42F 15/00*** | (2006.01) |
| ***B42F 21/06*** | (2006.01) |

(52) U.S. Cl.

CPC ..... *B42F 15/0082* (2013.01); *B42F 15/0094* (2013.01); *B42F 21/065* (2013.01)

USPC ..... 340/570; 340/540

(58) Field of Classification Search

CPC ..... G08B 13/14; H02B 1/26

USPC ..... 340/540, 570

See application file for complete search history.

(56) References Cited

U.S. PATENT DOCUMENTS

2011/0304456 A1* 12/2011 Zhu et al. ..... 340/540

* cited by examiner

*Primary Examiner* — Steven Lim
*Assistant Examiner* — Kaleria Know

(57) ABSTRACT

A storage container for use in a documents management system with remote location of file folders positioned on support members mounted between walls of the storage container. The support members are electrically connected to an electrical input connector which supplies file folder search signals to the container and receives response signals from address decoder circuits located in each file folder removably received in the container. Each container has an electrical output connector which can be connected to the electrical input connector of another container so that several containers can be connected to one another. Each container can be removably installed in a file cabinet drawer and electrically connected to the file drawer conductive rails to communicate with a file cabinet based file management system.

14 Claims, 9 Drawing Sheets

STORAGE CONTAINER FOR ELECTRONICALLY ADDRESSABLE FILE FOLDERS AND DOCUMENTS

BACKGROUND OF THE INVENTION

This invention relates to documents management in general, and in particular to a storage container for electronically addressable file folders and documents contained therein.

In medical records, legal and business offices, and some homes, file storage cabinets are typically used to store documents used for medical, legal, other business and personal purposes. A typical file storage cabinet has several pull-out drawers each containing a relatively large number of file folders, with each folder containing one or more documents. In order to enable the documents contained in the various file folders to be readily accessed, some type of documents management system is necessary.

Documents management is typically performed by file folder management. Each document is initially assigned to, and placed in, an identified file folder dedicated to documents of a particular subject matter (e.g., "utility bills for a specific account"). Later generated related documents are typically assigned to and placed in this same file folder.

File storage cabinets tend to be rather large and expensive. Consequently, the tendency is to employ only a minimum number of file storage cabinets to accommodate file folders containing frequently accessed documents. Documents which need not be frequently accessed are typically placed in storage containers, such as file boxes, which are then placed in a permanent storage area-either on premises or off premises, such as in a warehouse. Such storage containers are usually indexed and a master list is kept of the file folders and documents placed in the storage containers, along with the location of each storage container. When it is necessary to access a file folder or a specific document stored in such a container, the master list is consulted, the particular storage container containing the sought file folder is located, the storage container is opened, and the sought file folder is removed.

U.S. Pat. No. 5,977,875 issued Nov. 2, 1999 for "Collective Objects Management System Using R.F. Object Identification", the disclosure of which is hereby incorporated by reference, discloses an example of a file folder management system which eliminates the disadvantages with previously known file folder management systems. In addition, the file folder management system disclosed in the '875 U.S. patent provides a simple and efficient way to find a desired file folder stored somewhere in a large collection of different file folders. The system disclosed in the '875 U.S. patent uses R.F. sensitive circuits to maintain control of all file folders in a collection. Each file folder has an associated R.F. sensitive circuit which resonates at a unique frequency when an R.F. signal at that unique frequency is received by the circuit, and an indicator coupled to the R.F. circuit for identifying the file folder to a human operator. The indicator is preferably a visible indicator—such as an LED—coupled to the file folder in a convenient location which can readily be seen by a human operator when a file drawer is opened. Alternatively, an audible indicator—such as a buzzer—can be used.

More specifically, the folder circuit included in each file folder to be placed in a file drawer has a crystal responsive to a particular R.F. frequency, with the resonant frequency of a given crystal different from all the other crystals. Each file folder circuit is electrically coupled to a drawer signal input/output using the electrically conductive upper support rails usually found in conventional file cabinets. One of the rails is modified by electrically isolating that rail from the remaining electrically conductive elements in the drawer. Each drawer is provided with an indicator, preferably a flashing LED visible indicator, mounted on the front panel of the drawer. A current detector circuit is used to control the state of the drawer panel indicator.

All drawer input/output terminals are electrically coupled in parallel to an associated host computer, either using dedicated connectors (i.e., hard wired) or transceivers (i.e., wireless communication). The host computer includes an R.F. signal generator capable of generating signals matching all the crystal frequencies. To find a file folder, a user specifies that file folder to the computer, typically by using a keyboard or a mouse. The computer causes the R.F. signal generator to generate an R.F. signal whose frequency matches that of the crystal in the specified file folder. The R.F. signal is transmitted to all the file cabinets in the system, and thus to all the file drawers. If the specified file folder is located in any one of the drawers, the indicator on the front panel of the drawer containing that file folder, and the indicator of the correct file folder, are both activated. The user then opens the drawer with the active panel indicator and removes the file folder with the active file folder indicator. The file management system disclosed in the '875 U.S. patent eliminates the need for readable tabs or tags on each file folder, since the correct file folder is designated by the activated indicator. Also, the nature of a file folder can be changed by simply entering the necessary information into the computer. In addition, the integrity of the entire file system can be checked by using an R.F. sweep frequency generator to sweep the entire frequency range of crystal frequencies and detecting any frequency for which a resonant response is absent. The system can be readily and conveniently incorporated into existing file cabinets having the electrically conductive dual rail folder support mechanism.

Commonly assigned co-pending U.S. patent application Ser. No. 12/586,552, filed Sep. 24, 2009 for "Collective Objects Management System With Object Identification Using Multiple Crystals", the disclosure of which is hereby incorporated by reference, discloses an improvement over the '875 technique in which the file folder circuits are provided with two or more crystals and each file cabinet includes an R.F. generator. In this improved technique, a file folder is specified by generating an R.F. signal having a number of frequency components equal to the number of crystals in the file folder circuit.

Commonly assigned co-pending U.S. patent application Ser. No. 12/802,645, filed Jun. 12, 2010 for "Collective Objects Management System With Object Identification Using Addressable Decoder Units", the disclosure of which is hereby incorporated by reference, discloses another example of a file folder management system which eliminates the disadvantages with previously known file management systems. In addition, like the '875 system, the file management system disclosed in the '645 U.S. patent application provides a simple and efficient way to find an individual file folder stored somewhere in a large collection of different file folders. The system disclosed in the '645 U.S. patent application uses addressable decoder units to maintain control of all file folders in a collection. Each file folder has an associated addressable decoder unit with a unique address in the file folder management system which responds to the receipt of that unique address from a source. The source is a local encoder in the file cabinet containing the addressed file, which generates the unique address in response to the receipt of a file folder identification signal from a remote host computer. Each file folder also has an indicator coupled to the decoder unit for identifying the file to a human operator. The indicator is preferably a visible indicator—such as an LED—coupled to the file folder in a convenient location which can readily be seen by a human operator when a file drawer is opened. Alternatively, an audible indicator—such as a buzzer—can be used.

Each file drawer has a plurality of mutually electrically isolated electrically conductive paths, at least one of which can receive address signals supplied by the source and specifying a sought file folder. The file folders positioned in the file drawers each has a plurality of electrically conductive members, each of which is electrically coupled to a different one of the plurality of mutually electrically isolated electrically conductive paths, an address decoder circuit carried by the file folder in the drawer, the address decoder circuit having a unique system address, the address decoder circuit further having a plurality of electrically conductive terminals in electrical contact with the plurality of electrically conductive members, and an indicator, such as a visible indicator (e.g., an LED) coupled to the address decoder circuit for activation whenever the address decoder circuit detects an address signal present on at least one of the plurality of electrically conductive members and representative of the unique system address of that file folder.

Each file cabinet includes an encoder for generating the address signals, the encoder having at least one input terminal for receiving file folder identification signals from a host computer, at least one output terminal coupled to each address decoder circuit of the plurality of file folders, and circuitry for generating a signal representative of the unique system address of the file folder specified by the file folder identification signals from the host computer.

Each file folder has a pair of support braces, with one of the support braces containing the plurality of electrically conductive members. The address decoder circuit and the indicator of each of the file folders are carried by one of the two support braces of each file folder.

The file folder drawer has a front panel with an additional indicator mounted thereon; and the system further includes circuitry for operating the additional indicator whenever an address decoder circuit located in the file folder drawer detects an address signal present on the at least one of the plurality of electrically conductive members and representative of the unique system address of that address decoder.

Each address decoder circuit includes circuitry for generating a VALID signal whenever that address decoder circuit detects an address signal present on the at least one of the plurality of electrically conductive members and representative of the unique system address of that address decoder circuit.

A microcomputer located in the file cabinet supplies power signals to the plurality of file folders via some of the electrically conductive paths, and address signals via the at least one of the electrically conductive paths; and receives VALID signals generated by each address decoder circuit when an incoming address matches a given address decoder circuit system address. The microcomputer also includes circuitry for generating information signals identifying the location in the system of any address decoder circuit which generates a VALID signal. These information signals are transmitted back to the host computer for the purpose of file folder management.

While both of the two techniques for file folder management described above are extremely effective in providing a remote file folder location capability, and remote file folder management, neither provides any capability for remote document location or retrieval. It can frequently occur that a document originally specified to the document management system as being located in a particular file folder is absent from that particular file folder and, in some cases, absent from the entire system, usually due to human error. With known document management systems, this error only becomes known after a human operator—after having been directed to a particular file drawer of a particular cabinet-opens the drawer with the illuminated visible indicator, extracts the file folder with the illuminated visible indicator, inspects the contents of the extracted file folder, and discovers that the specific document sought is missing from the file folder. In such a case, not only has the human operator wasted time in going to the file cabinet; but also it can be most difficult and time consuming to locate the missing document. Other than conducting a physical search of all the file drawer file folders, the system accessibility logs, and personal interviews with all persons suspected of having contact with the missing document, there is no practical way of finding the missing document.

Commonly assigned co-pending U.S. patent application Ser. No. 12/803,712 filed Jul. 2, 2010 for "Documents Management Using Remote Document Location And Retrieval", the disclosure of which is hereby incorporated by reference, discloses a documents management system which is devoid of the above-noted disadvantages and which enables remote location and retrieval of individual documents located somewhere in a collection of documents in a file cabinet documents management system. The '712 system has a plurality of file cabinets each having a plurality of file drawers; a plurality of file folders located in the file drawers; and a plurality of documents located in the plurality of file folders. Each document has an RFID tag containing a document identifier and an electronic copy of the contents of the document. Each file cabinet has a control unit for receiving file folder request signals from a source, performing a file folder search in response to receipt of a file folder request signal, and sending a response to the source indicating the result of the file folder search. Each file folder has a circuit responsive to a search initiated by a file folder request signal for generating a response signal when the file folder request signal matches the identity of the file folder. Each file cabinet includes an RFID reader for receiving document request signals from a source, performing a document search in response to receipt of a document request signal, and sending the contents of a found document to the source.

The system may implement either an R.F. file folder search technique or an address matching file folder search technique. For the R.F. file folder search technique, the control unit includes an R.F. signal generator for generating search signals having a frequency component; and each file folder circuit has a crystal with a specific resonant frequency so that the response signal is generated when the frequency component of a search signal matches the resonant frequency of the crystal. For the address matching file folder search technique, the control unit includes an address encoder for generating a file folder address signal in response to the receipt of a file folder request signal; and the file folder circuit has an address decoder containing a unique address so that the response signal is generated when the address signal generated by the address encoder matches the unique address.

Once the desired file folder has been located, a search for the sought document is conducted. Each document includes an RFID tag with a read-only-memory containing a document identifier and an electronic version of the document. The search is performed by using an RFID reader unit and an RFID reader antenna to generate R.F. frequency document tag interrogation signals containing the document identifier.

When the document has been located, the RFID reader reads out the entire document contents and transmits this information to the source for follow-on use.

The '712 system facilitates the location of a given document by enabling remote searching of the entire document management system file cabinets. The invention also eliminates the necessity for having a human operator physically retrieve a document from the folder in which it is located. In addition, the invention affords remote inspection of the integrity of the document management system by sequentially generating file folder and document identifiers and noting the presence or absence of a response.

While the above-described systems afford efficient and effective documents management for file folders and documents contained in file cabinets, they do not address the problem of documents management for file folders and documents contained in storage containers of the type noted above.

SUMMARY OF THE INVENTION

The invention comprises a storage container which incorporates the electronically searchable functions of the documents management systems already described while affording the flexibility of individual storage containers for document and file folder storage purposes.

From an apparatus standpoint, the invention comprises a storage container having a base wall and a plurality (preferably four) of upstanding wall members together defining an enclosure volume. First and second electrically conductive file folder support members are mounted with the enclosure volume in essentially parallel and mutually laterally spaced fashion to provide both mechanical support and electrical connections to the ends of file folder braces when a file folder is removably installed in the container. The spacing between the support members matches that of the spacing between the ends of a legal size file folder or a letter size file folder. An electrical input connector, preferably a USB connector, is secured to one of the upstanding wall members to furnish file folder search signals supplied from an external source to the support members. An electrical output connector secured to one of the upstanding wall members is provided to manifest file folder search signals which can be coupled to the electrical input connector of another storage container so that several containers can be coupled together to form a searchable array.

A light source, preferably an LED light source is secured to one of the upstanding wall members in a location which is externally visible, the light source being illuminated whenever the file folder search signals match the address of a file folder located in the container.

In a first alternate embodiment, the support members each have an end extending beyond one of the upstanding wall members so that the container can be removably installed in a file cabinet drawer and electrically connected to the paired conductive rails in the file drawer to make the container compatible with a file cabinet management system.

In another alternate embodiment, the support members have an L-shaped form to provide two sets of mutually spaced support regions: one set for accommodating legal size file folders; the other set to accommodate letter size file folders.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figures 1, 2, 3:
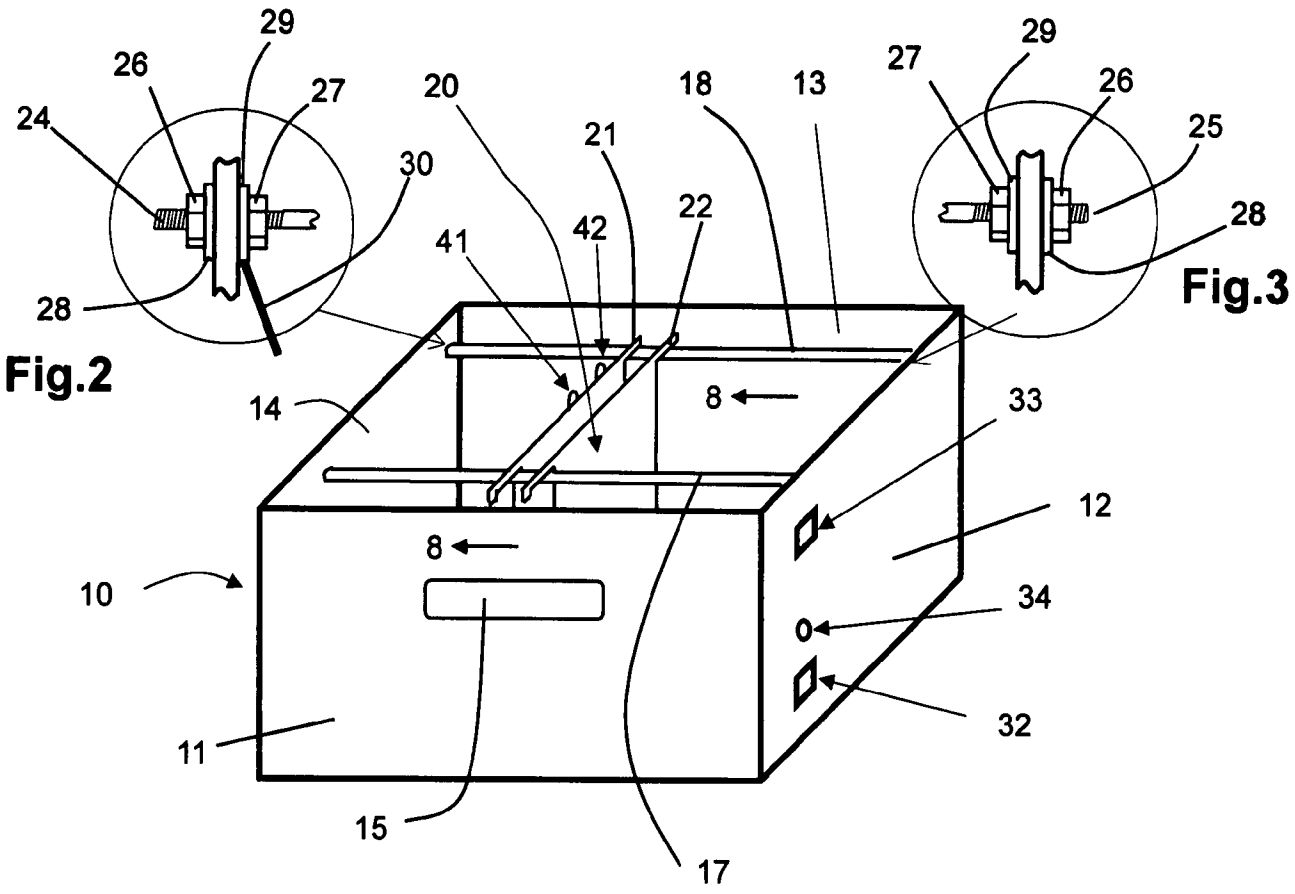
FIG. 1 is a perspective view of a storage container according to the invention.
FIG. 2 is an enlarged fragmentary view illustrating the mechanical and electrical connections for one end of a file folder support brace.
FIG. 3 is an enlarged fragmentary view illustrating the mechanical and electrical connections for the other end of the file folder support brace.

Turning now to the drawings, FIG. 1 is a perspective view of a storage container generally designated with reference numeral 10 according to the invention, with the container top cover removed. As seen in this FIG., a conventional storage container, such as a unitary box container fabricated from molded plastic, has four upstanding walls 11-14 and an integral base (not shown). A handle recess 15 is formed in wall 11 and a corresponding recess (not illustrated) is formed in wall 13 to facilitate transport of container 10. A pair of electrically conductive file folder support members 17, 18 is mounted in the interior volume of container 10, with each support member spanning the width of container 10. As described more fully below, the lateral spacing of support members 17, 18 matches the spacing between the end portions of the support braces 21, 22 of each file folder 20 so that each file folder 20 is removable supported by the support members 17, 18. In the FIG. 1 embodiment, this spacing equals the spacing between the end portions of support braces 21, 22 of either a standard legal size file folder or a standard letter size file folder.

FIGS. 2 and 3 illustrate one technique for mounting members 17, 18 in container 10. As seen in these figs., each support member 17, 18 comprises a rod having opposite threaded ends 24, 25. Each threaded end 24, 25 is received in an aperture (not illustrated) is a confronting wall (wall 14 for threaded end 24; wall 12 for threaded end 25) and is secured to the confronting wall 14, 12 by means of nuts 26, 27 and washers 28, 29. Electrical connection to support members 17, 18 is provided by a conductive wire 30 ohmically connected to one end of the support member, as illustrated in FIG. 2 for support member 18.

Container 10 is provided with an input connector 32, an output connector 33 and an LED light source 34, preferably mounted on a single wall, such as wall 12. Input connector 32 receives input signals from a source described below and these input signals are coupled via that one of the support members 17, 18 electrically coupled to the input connector 32 by conductive wire 30 to all file folders 20 removably supported in container 10. Output connector 33 can be coupled to the input connector 32 of another storage container 10 when two or more containers 10 are electrically cascaded together in the manner described below. Input connector 32 and output connector 33 are preferably conventional USB connectors. LED light source 34 is activated whenever an address signal is generated specifying the address of one of the file folders 20 removably supported by support members 17, 18 in that container 10, thus providing a visible indication that a sought file folder is located in that container 10.

Figure 4:
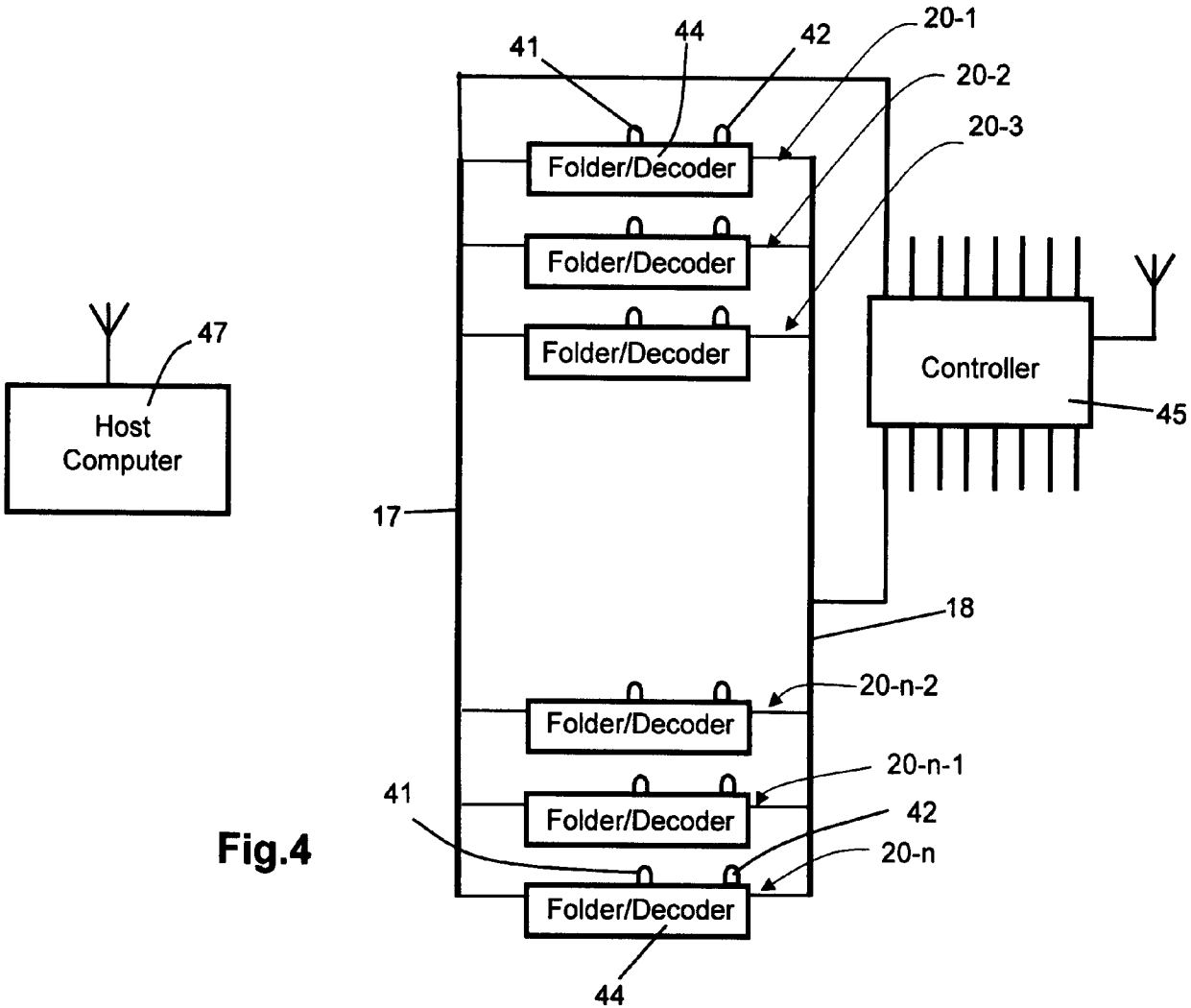
FIG. 4 is a schematic top view of the storage container of FIG. 1 illustrating the major electronic components of the system.

FIG. 4 is a schematic top view of the storage container of FIG. 1 illustrating the major electronic components of the system. This system implements the system shown and described in the above-referenced '645 U.S. patent application. As seen in this FIG., a plurality of file folders 20-1, 20-2, . . . , 20-n are removably supported by support members 17, 18. Each file folder is provided with a folder LED 41, a power LED 42, and a circuit which includes an address decoder 44. Folder LED 41 of a given file folder 20i is activated whenever an incoming signal from a controller 45 matches the system address of that file folder 20i, as determined by the address decoder 44 of that file folder 20i. Power LED 42 of a given file folder 20i is activated whenever that folder is ohmically connected to support members 17, 18. Address decoder 44 is preferably a type PT2272 unit available from Princeton Technology Corporation of Taipei, Taiwan. Controller 45 comprises a microcomputer such as a type AT89C2051 unit available from Intel Corporation of Santa Clara, Calif. and an address encoder such as a type PT2262 unit available from Princeton Technology Corporation of Taipei, Taiwan. Controller 45 is electrically coupled to support members 17, 18. A host computer 47 provided with wi-fi capability communicates with controller 45, which is also provided with wi-fi-capability. Alternatively, host computer 47 and controller 45 may be hard wired together, when desired. Host computer 47 generates file folder identification signals which are communicated to controller 45. Controller 45 converts these file folder identification signals to system address signals, which are coupled to all of the file folders 20i located in storage container. When an address match exists, controller 45 communicates the existence of the address match to host computer 47, along with a signal uniquely identifying the storage container in which the file folder 20i is located.

Figure 5:
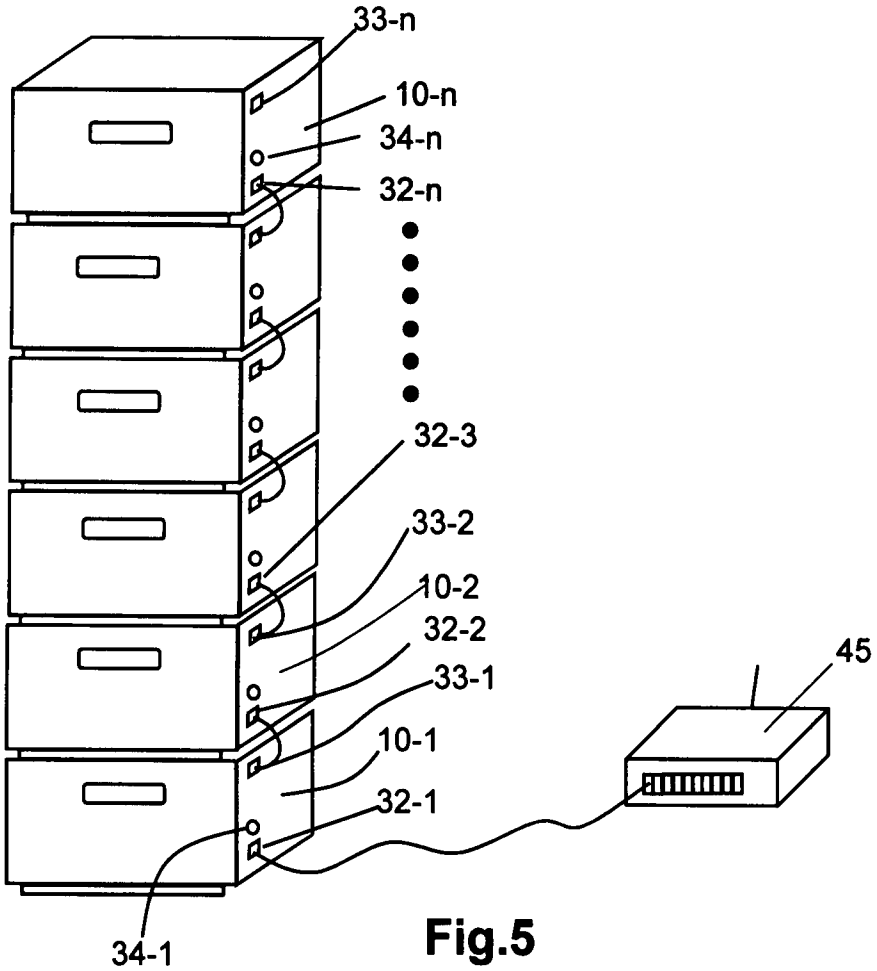
FIG. 5 is a schematic perspective view illustrating the stacked configuration of a plurality of storage containers and a controller.

FIG. 5 is a schematic perspective view illustrating the stacked configuration of a plurality of storage containers 10i and a single controller 45. As seen in this FIG., a plurality of storage containers 10-1, 10-2, . . . , 10-n are vertically arranged one on top of another to form a column of storage containers 10i. Controller 45 is electrically interfaced with a first storage container 10-1 by a single connector cable 50 which is electrically coupled at one end to an interface connector 51 of controller 45 and at the other end to the input connector 32-1 of storage container 10-1. The output connector 33-1 of storage container 10-1 is electrically coupled to the input connector 32-2 of a second one 10-2 of storage containers 10i. The output connector 33-2 of storage container 10-2 is electrically coupled to the input connector 32-3 of a third one 10-3 of storage containers 10i, etc., so that all storage containers 10i are electrically cascaded and controlled by controller 45. As presently implemented, controller 45 is capable of controlling up to eight storage containers 10i in the cascaded arrangement illustrated.

Figure 6:
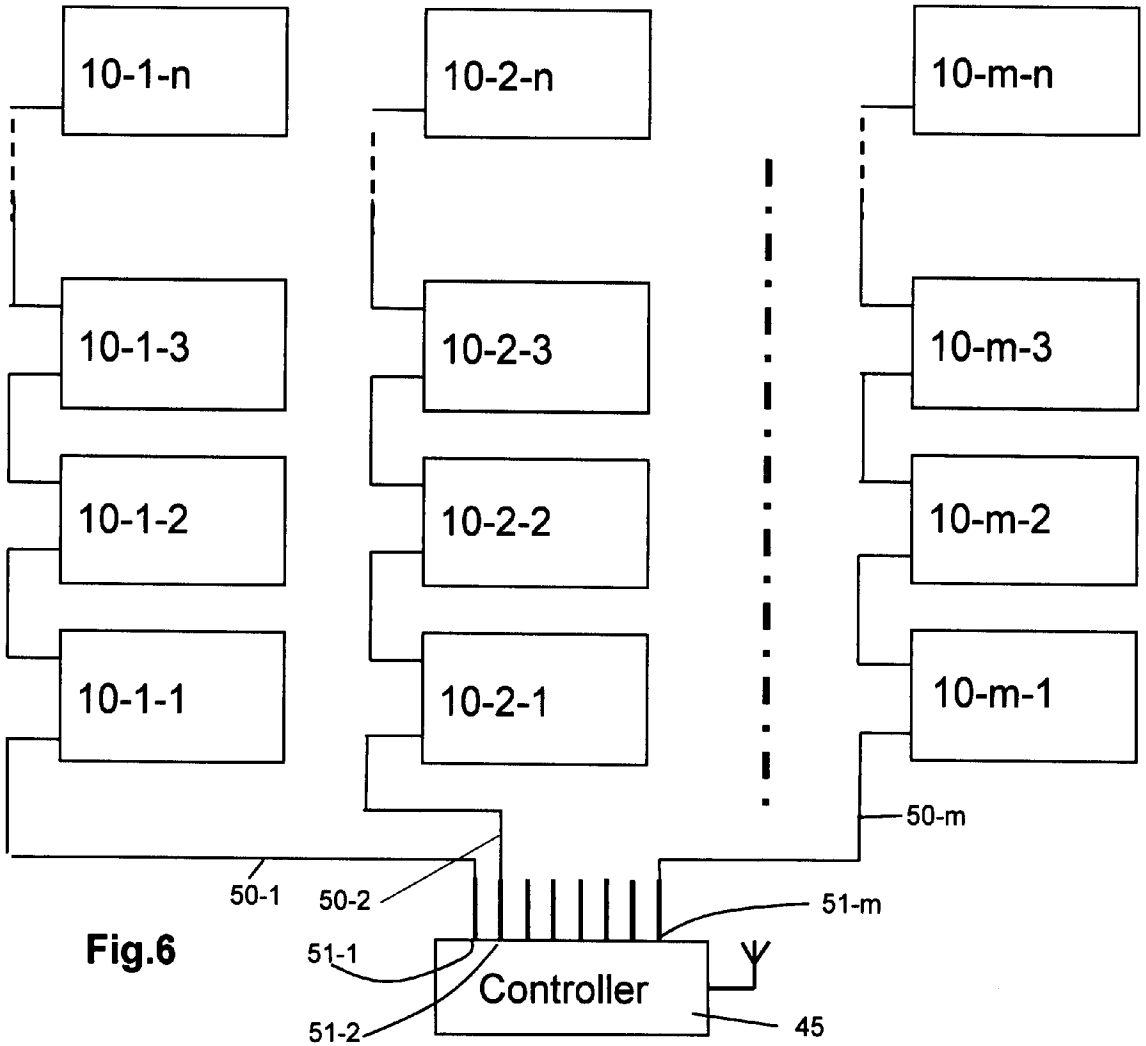
FIG. 6 is a block diagram illustrating the connections between a single controller and a plurality of stacks of individual storage containers.

Although FIG. 5 illustrates a controller 45 having a single interface connector 51, as presently implemented and as illustrated in FIG. 6 (which is a block diagram illustrating the connections between a single controller 45 and a plurality of stacks of individual storage containers 10i) controller 45 is provided with a plurality (eight in the preferred embodiment) of interface connectors 51-1, 51-2, . . . , 51n. Each interface connector 51i is electrically coupled to the first storage container 10i in an associated collection of up to eight storage containers 10i. Thus, interface connector 51-1 is coupled via connector cable 50-1 to the input connector of storage container 10-1-1, interface connector 51-2 is coupled via connector cable 50-2 to the input connector of storage container 10-2-1; . . . , and interface connector 51-n is coupled via connector cable 50-n to the input connector of storage container 10-n-1.

Figure 7:
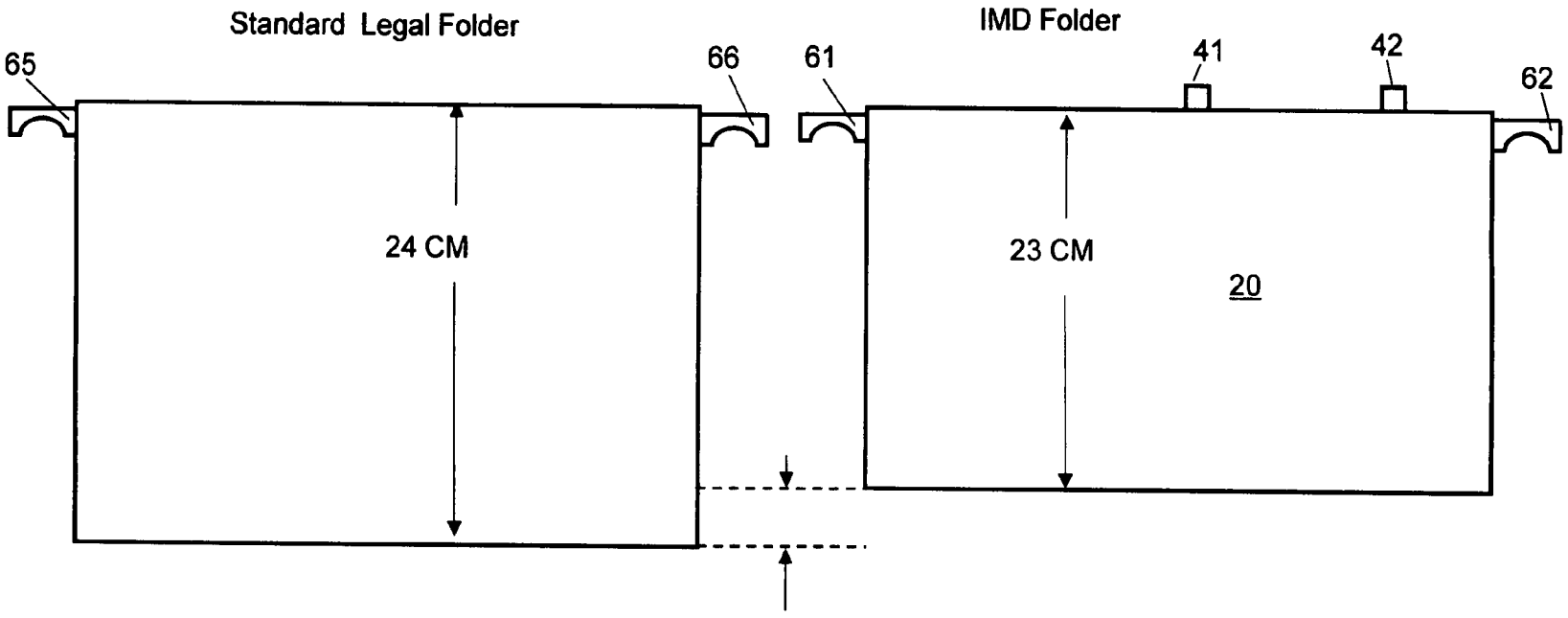
FIG. 7 is a plan view of a standard legal size folder and a special folder for use with the storage container of FIG. 1.
Figure 8:
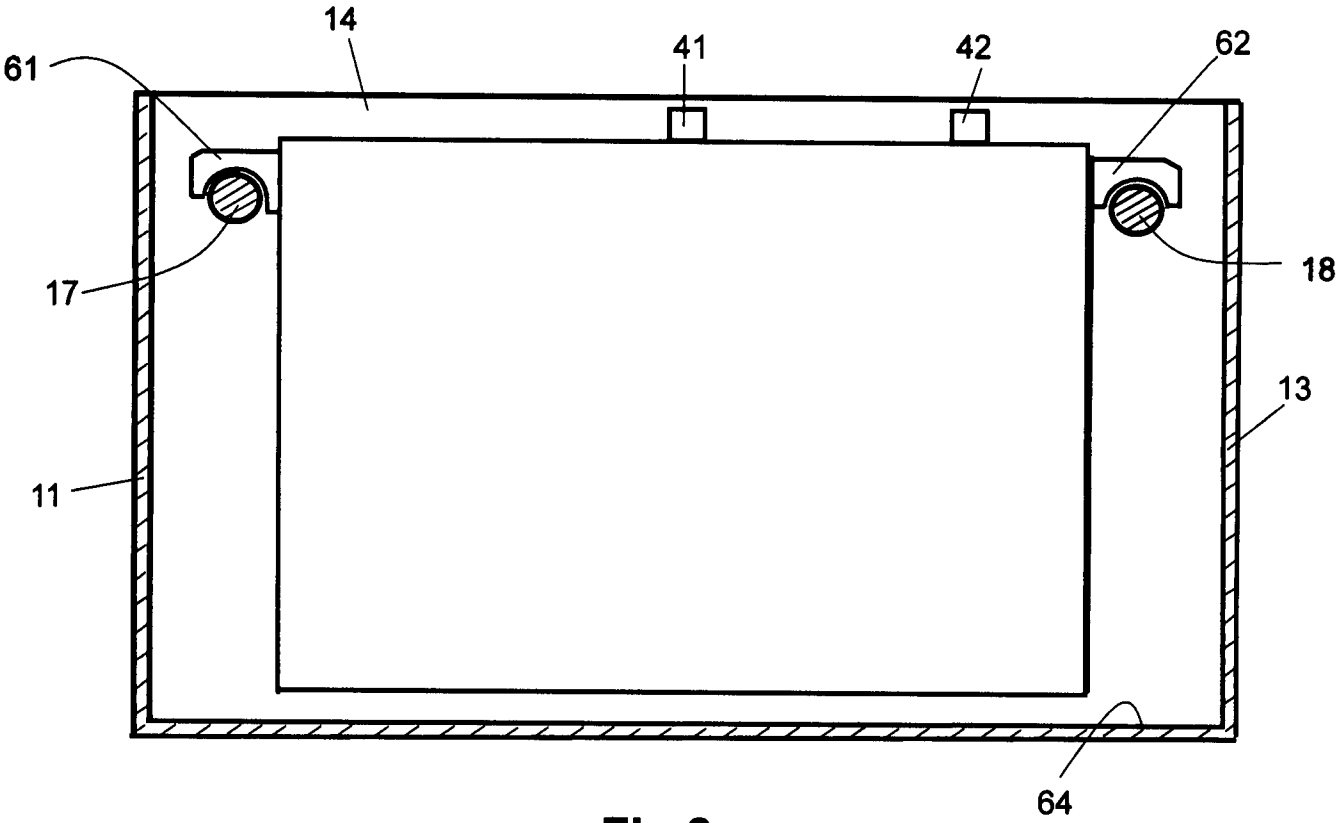
FIG. 8 is a sectional view taken along lines 8-8 of FIG. 1 illustrating the positioning of a special folder installed in a storage cabinet.
Figure 9:
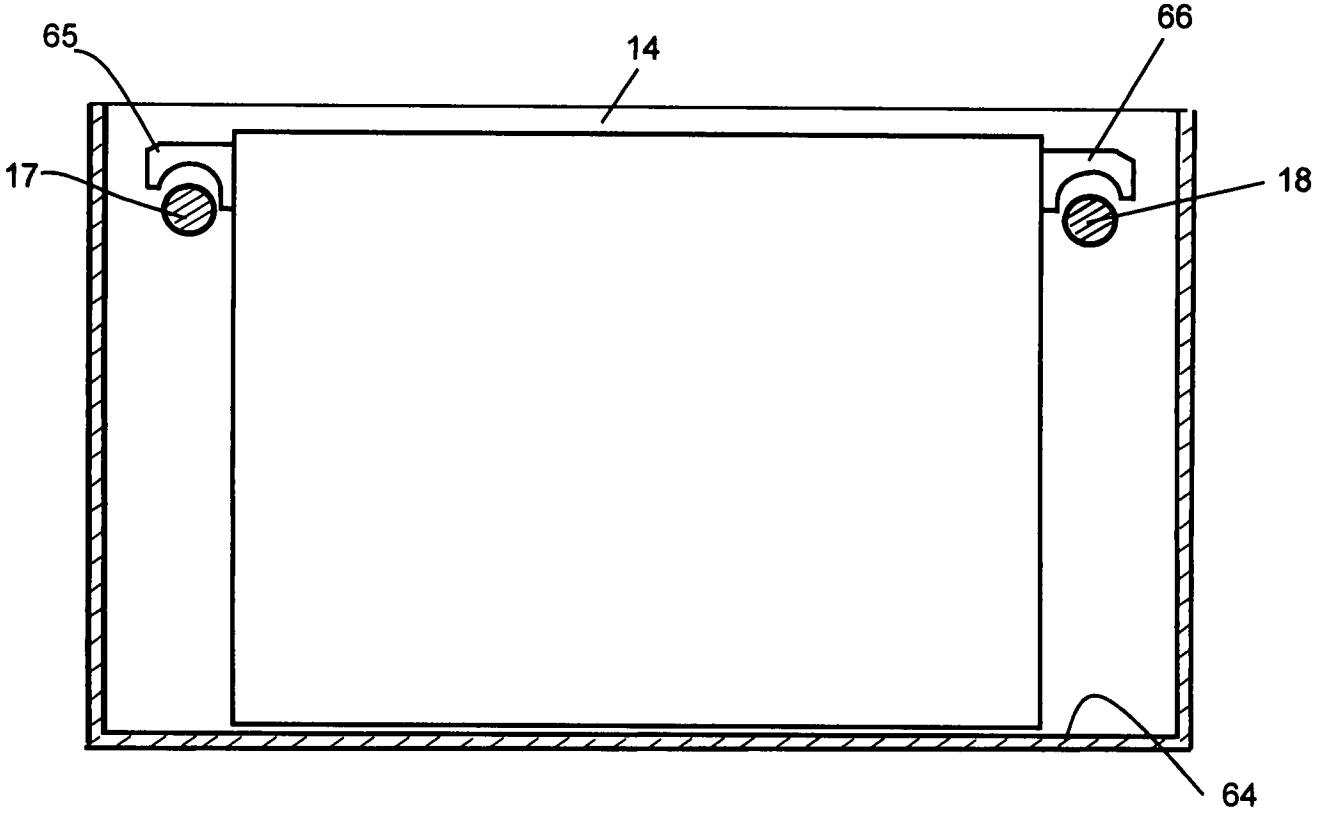
FIG. 9 is a sectional view similar to FIG. 8 illustrating the positioning of a standard legal folder installed in a storage cabinet.

Some standard file folders have support braces which are electrically conductive along their length. If such a folder is mistakenly installed in a storage container, contact between the folder brace and both support members 17, 18 can electrically short out the system and cause critical damage. To preclude this possibility, the vertical dimension of file folders 20 designed for use with the system of the invention is smaller than the vertical dimension of a standard file folder. This is illustrated in FIGS. 7-9. FIG. 7 is a plan view of a standard legal size folder and a special folder for use with the storage container 10 of FIG. 1. As is evident, file folder 20 positioned to the right of FIG. 7 has a smaller vertical dimension than the standard file folder positioned to the left in FIG. 7. In the preferred embodiment, this difference is 1 cm. When an authorized file folder 20 is installed in a storage cabinet 10, the support brace ends 61, 62 rest on a portion of the surface of support members 17, 18 as shown in FIG. 8 with the bottom margin of file folder 20 positioned above the upper surface 64 of the bottom wall of storage container 10. This is accomplished by carefully selecting the vertical spacing between support members 17, 18 and the upper surface 64 of the bottom wall to ensure a space between the bottom margin of file folder 20 and upper surface 64 so that the weight of file folder 20 will ensure effective mechanical and electrical contact with support members 17, 18. In contrast, and as illustrated in FIG. 9, the vertical spacing between support members 17, 18 and the upper surface 64 of the bottom wall is also carefully selected to ensure no effective mechanical and electrical contact between support members 17, 18 and the end portions of the support braces of a standard file folder. This is accomplished by selecting a value of the vertical spacing which ensures that the bottom margin of a standard file folder will make physical contact with the upper surface 64 before the end portions 65, 66 make contact with support members 17, 18.

Figure 10:
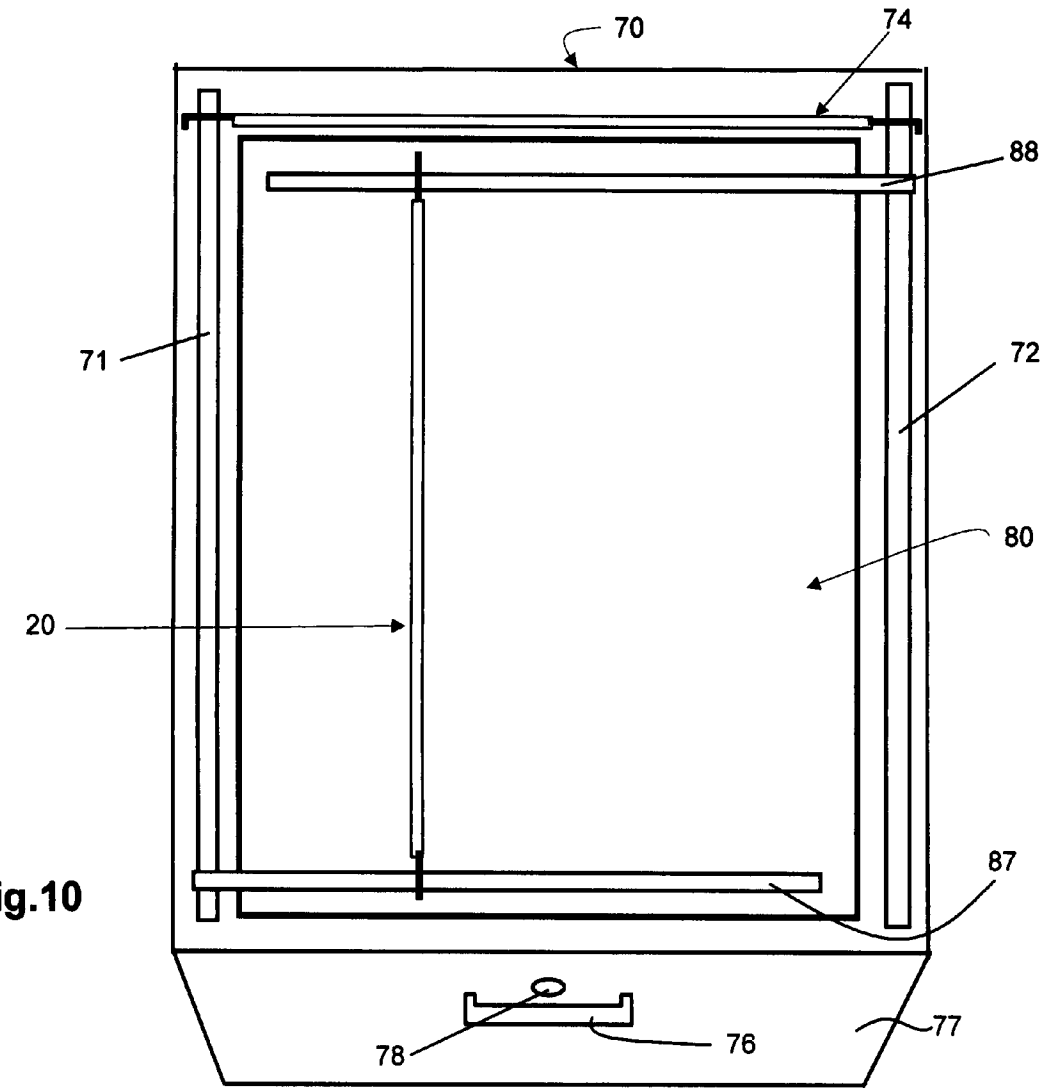
FIG. 10 is schematic top plan view illustrating a modification to the storage container of FIG. 1 for use with a file cabinet drawer.

FIG. 10 is a schematic top plan view illustrating a modification to the storage container 10 of FIG. 1 for use with a file cabinet drawer. As seen in this FIG., a standard file cabinet drawer 70 modified in accordance with the teachings of the above-referenced '875 U.S. patent or the above-referenced '552, '645, or '712 U.S. patent applications to afford electronically searchable file and document management has a pair of electrically conductive support rails 71, 72 extending forward and aft of drawer 70 for providing physical support and electrical connections to a removable file folder 74. Drawer 70 has a handle 76 secured to a front panel 77 for facilitating movement of drawer 70 between a closed position and an open position. A drawer LED 78 is mounted to front panel 77, LED 78 being illuminated whenever a sought file folder is located in drawer 70.

Situated within the confines of drawer 70 is a modified storage container 80 similar in structure and function to storage container 10 described above, but having modified support members 87, 88. Each support member 87, 88 is modified by extending one end a sufficient distance to be supported by one of the drawer support rails 71, 72. Thus, as viewed in FIG. 10, support member 87 is extended to the left so as to be supported by support rail 71, while support member 88 is extended to the right so as to be supported by support rail 72. The lateral spacing between support members 87, 88 is the same as that described above for support members 17, 18 of storage container 10. Since support members 87, 88 are electrically conductive, a file folder 20 carried by these two members can be accessed by the system by signals presented to electrically conductive rails 71, 72. Thus, the modified storage container 80 can be used as a stand-alone device or a multiple-stacked device in combination with a controller 45, or with a cabinet-based file management system.

Figure 11:
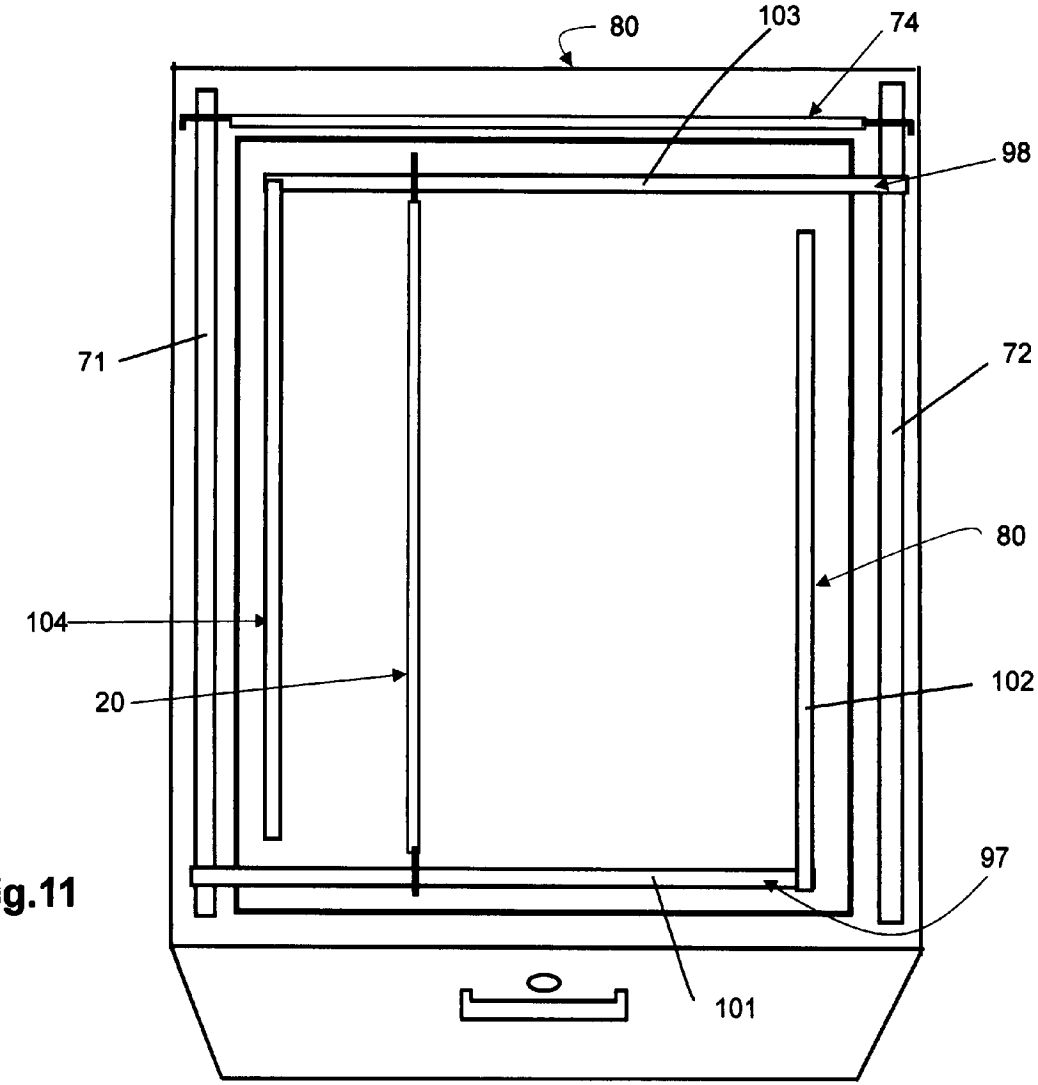
FIG. 11 is a view similar to FIG. 10 illustrating a modification of the container support members to accommodate both legal size folders and letter size folders.

FIG. 11 is a schematic top plan view illustrating a modification to the support members of storage container 80 of FIG. 10 for use with a file cabinet drawer and which can accommodate both legal size folders and letter size folders. As seen in this FIG., storage container 80 is provided with support members 97, 98 which are L-shaped. Support member 97 thus has a main leg 101, and a shorter leg 102; while support member 98 has a main leg 103 and a shorter leg 104. The lateral spacing between main legs 101 and 103 matches the spacing between ends of a legal size folder, while the spacing between shorter legs 102 and 104 matches the spacing between ends of a letter size folder. This, the modified storage container of FIG. 11 can be used to store either legal size folders or letter size folders.

Storage containers fabricated according to the teachings of the invention extend the advantages of the computer based file management systems noted above to easily portable and storable document storage containers. These advantages are as follows. Firstly, any folder located in any storage container can be readily located by entering the file folder identification into the host computer and initiating a search; if a file folder is located in ant storage container, the container LED will be illuminated indicating the storage container in which the sought file folder is located. When the file folder contents of that storage container are viewed (e.g., by removing the cover for that storage container), the folder LED 41 of the sought file folder will be illuminated. In addition, the file folder integrity of the entire collection of file folders can be ascertained by initiating a host computer system sweep of all known file folder addresses, which will result in a list of missing file folders.

Although the above provides a full and complete disclosure of the preferred embodiments of the invention, various modifications, alternate constructions and equivalents will occur to those skilled in the art. For example, while the invention has been described with reference to addressable decoder file folder units, the crystal-based R.F. technology may be used to implement the individual storage containers. Moreover, the L-shaped support member modification may be implemented in the storage container shown in FIG. 1. Therefore, the above should not be construed as limiting the invention, which is defined by the appended claims.

What is claimed is:

1. A portable document storage container for enabling remote location and retrieval of documents located in file folders received within said storage container, said container comprising:

a base wall having an upper surface;

a plurality of upstanding wall members connected to said base wall, said base wall and said plurality of upstanding wall members defining an enclosure volume;

first and second electrically conductive support members each secured to at least one of said wall members in an essentially parallel and mutually spaced manner at a vertical distance above said upper surface of said base wall, said vertical distance being sufficiently great to ensure that a file folder designed for use with said storage container and having a bottom margin can be supported by said first and second support members in said enclosure volume with the bottom margin positioned above said upper surface in non-contacting relation thereto, said vertical distance being sufficiently small to ensure that a standard file folder having at least one support brace with a pair of opposing ends and a bottom margin received within said enclosure volume is positioned with the bottom margin in contact with said upper surface of said base wall with the opposing ends in non-contacting relation with said first and second electrically conductive support members, the spacing between said first and second support members being sufficient to accommodate the ends of a file folder in mechanically supportive fashion; and an electrical input connector secured to one of said upstanding wall members and ohmically coupled to said first and second support members for providing file folder search signals supplied by a source to at least one of said first and second support members, so that said file folder search signals are coupled to any file folder supported by said support members.

2. The invention of claim 1 further including a container light source mounted to one of said wall members in a location visible from the exterior of said container, said light source being ohmically connected to said electrical input connector.

3. The invention of claim 2 wherein said light source is an LED.

4. The invention of claim 1 further including an electrical output connector secured to one of said upstanding wall members and ohmically coupled to said first and second support members for manifesting said file folder search signals supplied by a source to at least one of said first and second support members, so that said file folder search signals can be coupled to support members located in another document storage container having an electrical input connector coupled to said electrical output connector.

5. The invention of claim 1 wherein each of said support members has an end extending beyond one of said upstanding wall members so that said container can be supported by external rails mounted in a file drawer.

6. The invention of claim 1 wherein each of said support members has an L-shape comprising first and second leg portions.

7. The invention of claim 6 wherein the spacing between said first leg portions of said first and second support members is sufficient to accommodate the ends of a legal size file folder and wherein the spacing between said second leg portions of said first and second support members is sufficient to accommodate the ends of a letter size file folder.

8. An array of portable document storage containers for enabling remote location and retrieval of documents located in file folders received with said storage containers, said array comprising:

a plurality of document storage containers each having a base wall with an upper surface, a plurality of upstanding wall members connected to said base wall, said base wall and said plurality of upstanding wall members defining an enclosure volume, first and second electrically conductive support members each secured to at least one of said wall members in an essentially parallel and mutually spaced manner at a vertical distance above said upper surface of said base wall, said vertical distance being sufficiently great to ensure that a file folder designed for use with said storage container and having a bottom margin can be supported by said first and second support members in said enclosure volume with the bottom margin positioned above said upper surface in non-contacting relation thereto, said vertical distance being sufficiently small to ensure that a standard file folder having at least one support brace with a pair of opposing ends and a bottom margin received within said enclosure volume is positioned with the bottom margin in contact with said upper surface of said base wall with the opposing ends in non-contacting relation with said first and second electrically conductive support members, the spacing between said first and second support members being sufficient to accommodate the ends of a file folder in mechanically supportive fashion, an electrical input connector secured to one of said upstanding wall members and ohmically coupled to said first and second support members, and an electrical output connector secured to one of said upstanding wall members and ohmically coupled to said first and second support members, the output connector of some of said document storage containers being coupled to the input connectors of other ones of said document storage containers to form an electrically intercoupled array; and a controller having an output coupled to the input connector of one of said plurality of document storage containers for providing file folder search signals supplied by a source to at least one of said first and second support members of the document storage container connected thereto, said file folder search signals being coupled to all of said document storage containers in said electrically intercoupled array so that said file folder search signals are coupled to any file folder supported by said support members in any of said document storage containers in said intercoupled array.

9. The invention of claim 8 wherein all of said plurality of document storage containers are electrically intercoupled.

10. The invention of claim 8 wherein said controller includes a file folder address encoder for converting file folder search signals received from source to file folder address signals, each file folder address signal being unique to a given file folder.

11. The invention of claim 8 wherein each of said plurality of document storage containers includes a container light source mounted to one of said wall members in a location visible from the exterior of said container, said light source being ohmically connected to said electrical input connector.

12. The invention of claim 11 wherein each of said light sources is an LED.

13. The invention of claim 8 wherein each of said support members in at least one of said document storage containers has an L-shape comprising first and second leg portions.

14. The invention of claim 13 wherein the spacing between said first leg portions of said first and second support members is sufficient to accommodate the ends of a legal size file folder and wherein the spacing between said second leg portions of said first and second support members is sufficient to accommodate the ends of a letter size file folder.

* * * * *